US005988984A

United States Patent [19]

Austin

[11] Patent Number: 5,988,984

[45] Date of Patent: Nov. 23, 1999

[54] METHOD AND APPARATUS FOR LIQUID CONTROL SYSTEM HAVING A VALVE WITH A NOTCH IN THE SEAL FOR ENABLING A SUFFICIENT FLUID TO PASS THROUGH WHEN THE SEAL IS FULLY CLOSED TO COOL THE PUMP AND/OR MOTOR

[76] Inventor: Cary M. Austin, 8104 19th St., Lubbock, Tex. 79407

[21] Appl. No.: 08/886,905

[22] Filed: Jul. 2, 1997

Related U.S. Application Data

[63] Continuation-in-part of application No. 08/427,448, Apr. 24, 1995, abandoned, which is a continuation-in-part of application No. 08/103,340, Aug. 6, 1993, abandoned.

[51] Int. Cl.[6] ..... F04B 49/08

[52] U.S. Cl. ..... 417/44.2; 417/53

[58] Field of Search ..... 417/44.2, 26, 53, 417/44, 43, 31, 441, 507, 28, 58; 137/568

[56] References Cited

U.S. PATENT DOCUMENTS

| | | | |
|---|---|---|---|
| 2,737,975 | 3/1956 | Wilkins | 137/505.44 |
| 3,141,475 | 7/1964 | Guinard et al. | 137/568 |
| 3,150,684 | 9/1964 | Guinard et al. | 137/568 |
| 3,322,145 | 5/1967 | Prosser | 137/517 |
| 3,739,810 | 6/1973 | Horan | 137/568 |
| 3,782,858 | 1/1974 | Deters | 417/26 |
| 3,814,543 | 6/1974 | Gritz | 417/26 |

OTHER PUBLICATIONS

Jacuzzi Technical Data Sheet E–940 Aquagenie 200 Valve Jan. 1, 1990.

*Primary Examiner*—Charles G. Freay
*Assistant Examiner*—Robert Z. Evora
*Attorney, Agent, or Firm*—Wendell Coffee; Mark Scott

[57] ABSTRACT

A water system uses a pressure reservoir of extremely small size. A valve device is placed between a water pump and the pressure reservoir. The valve device has a constant outlet pressure to limit the flow from the pump at high pressures. The pump is turned on and off by a pressure on/off switch. The valve device maintains the pressure to the reservoir at or below the on switch pressure except for a dribble flow. The dribble flow fills the reservoir when there is little or no water usage from the reservoir. The dribble flow is achieved by a notch in the valve surfaces of the valve device. Each time the valve opens any debris in the notch is washed from the notch thereby keeping the notch free of debris.

19 Claims, 3 Drawing Sheets

METHOD AND APPARATUS FOR LIQUID CONTROL SYSTEM HAVING A VALVE WITH A NOTCH IN THE SEAL FOR ENABLING A SUFFICIENT FLUID TO PASS THROUGH WHEN THE SEAL IS FULLY CLOSED TO COOL THE PUMP AND/OR MOTOR

CROSS REFERENCE TO RELATED APPLICATION

This is a continuation in part of my prior application on this subject matter filed Apr. 24, 1995, Ser. No. 08/427,448, now abandoned, which was a continuation in part of my application filed Aug. 6, 1993, Ser. No. 08/103,340 which is now abandoned. Specific reference is made to those documents.

BACKGROUND OF THE INVENTION (1) Field of the Invention

This invention relates to liquid pumps and liquid systems and more particularly to a valve and system to prevent a motor driving a liquid pump from cycling, that is quickly and repeatedly turning off and on. Owners and operators of water systems have ordinary skill in the art of this invention.

(2) Description of the Related Art

Many water pumps supply water to a system having irregular, intermediate use. Often these water pumps supply water into a small reservoir such as a pressure tank. Water systems normally have a range of operating pressures. For example, the range of water of pressures is set between 40 and 60 p.s.i.. This pressure range is normally achieved with a pressure switch which cuts off the motor to the pump at 60 p.s.i. and then turns it on at a pressure of 40 p.s.i. If the use is such that the small pressure tank is quickly drained, the motor is switched on, the pump fills the pressure tank quickly, the pump switches off, and then as the pressure tank is quickly drained, the pump switches on again. Most of the wear and damage to the motors and the pumps is caused by the numerous repeated starts and stops of the system.

Such a system as described is common on residential water supplies having a separate water supply for every residence, as often occurs in rural areas. Also the problem arises in systems that have irregular irrigation, for example, golf courses where different flow rates are required. Some systems with cycling problems have multiple pump stations which are activated according to the different supplies of water needed. Also the system with cycling problems exists with tall buildings where because of the building height it is necessary to have controls for different levels of the building, and different flow rates.

The problem also exists in liquid systems other than water. For example, the ordinary gasoline fuel dispenser at an auto service station has an electric motor driven pump which delivers fuel to a small pressure tank, then to a metering device, and then to the manually controlled nozzle. When the auto tank is nearly full the customer will often reduce the flow to a dribble to "top off" the tank. This will cause the motor to cycle on and off.

Constant outlet pressure valves are well known to the art. Such valves are designed to reduce the flow if the outlet pressure is above the optimum range and to completely stop the flow when it exceeds the preset pressure.

Before this invention, attempted solutions to alleviate this problem included installing a constant outlet pressure valve with a small bypass around the constant outlet pressure valve. The valve is installed downstream of the pump and upstream of the pressure tank and pressure switch. As an example, if the normal flow is fifteen gallons per minute, the bypass provides a flow of one gallon per minute. Therefore when there is a small volume of flow, the liquid will continue to flow through the bypass and slowly refill the pressure tank. When the pressure tank is sufficiently full, the pressure switch will shut the motor off. The pressure tank will supply the need until the water flow again reaches levels so that the pressure switch closes, starting the pump motor to fill the pressure tank. However these bypasses exhibited certain problems. One of which is often the bypass will be noisy because of the pressure of the liquid flowing through a small opening. Also the small opening is susceptible to being clogged by debris.

The constant outlet pressure valves (called the valve device herein) often have a plane (or flat) valve seat seating the surface and a plane valve element seating surface that moves normal to the valve seating surface.

SUMMARY OF THE INVENTION (1) Progressive Contribution to the Art

This invention solves the problem by cutting a notch in one of the seating surfaces on either the valve seat or the valve device. Therefore when the valve is closed, the dribble or trickle flow is through this notch. Experience has shown that this will not be a noisy flow. Also experience has shown that it will not clog. Each time the valve opens any debris which might otherwise collect in the restricted flow device (the notch) is flushed out by the opening of the valve and the flow of liquid across the notched surface.

(2) Objects of this Invention

An object of this invention is to provide a valve device with controlled outlet pressure.

Another object of this invention is to prevent cycling of motors on liquid pumps feeding small reservoirs.

A further object of this invention is to prevent the cycling with a non-clogging dribble flow through a constant outlet pressure valve.

Further objects are to achieve the above with devices that are sturdy, compact, durable, lightweight, simple, safe, efficient, versatile, ecologically compatible, energy conserving, and reliable, yet inexpensive and easy to manufacture, install, operate, and maintain.

Other objects are to achieve the above with a method that is versatile, ecologically compatible, energy conserving, efficient, and inexpensive, and does not require highly skilled people to install, operate, and maintain.

The specific nature of the invention, as well as other objects, uses, and advantages thereof, will clearly appear from the following description and from the accompanying drawings, the different views of which are not necessarily scale drawings.

BRIEF DESCRIPTION OF THE DRAWINGS

FIG. 6 is schematic representation of a underground water system.

CATALOGUE OF ELEMENTS

Figure 1:
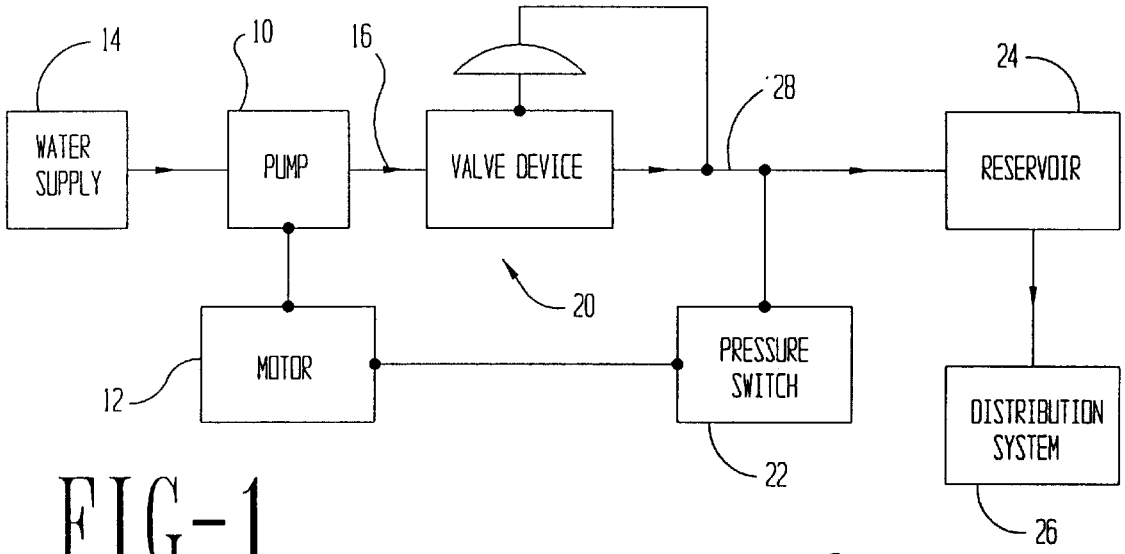
FIG. 1 is a schematic representation of a liquid system using a valve device according to this invention.

As an aid to correlating the terms of the claims to the exemplary drawing(s), the following catalog of elements and steps is provided:

| | |
|---|---|
| 10 | pump |
| 12 | motor |
| 14 | water supply |
| 16 | downstream pipe |
| 18 | well casing |
| 20 | valve device |
| 21 | air cap |
| 22 | pressure switch |
| 23 | reservoir opening |
| 24 | reservoir |
| 25 | bladder |
| 26 | distribution system |
| 28 | reservoir entrance pipe |
| 30 | housing |
| 32 | upstream space |
| 34 | downstream space |
| 36 | valve seat |
| 38 | valve seat seating surface |
| 40 | movable valve element |
| 42 | plane valve element seating surface |
| 44 | valve extension |
| 46 | valve partition |
| 48 | seal |
| 50 | disc |
| 52 | spring |
| 54 | diaphragm |
| 55 | diaphragm chamber |
| 56 | valve body space |
| 57 | vent |
| 58 | adjusting screw |
| 60 | top of spring |
| 64 | notch |

DESCRIPTION OF THE PREFERRED EMBODIMENT

An embodiment of the valve device according to this invention is designed to work with motor driven pumps which are non-positive displacement. The valves would also work with a positive displacement pump if the pump were powered by a motor which would reduce its speed with increased back pressure on the pump. However usually the valves are used on pumps wherein with the pump's constant velocity, the flow rate of the pump decreases with increased pressure. The most common of pumps of this type are centrifugal pumps. Some of this type are either axial flow pumps (the water flows parallel to the axis of the rotating pump) or at least combined partially centrifugal.

The valve devices of this invention will always include a valve seat and a valve element which moves relative to the valve seat. Often the valve seat and the valve each have a plane surface and the surfaces are always parallel in their relationship. However in some cases the valve surfaces are conical. Also some valves have a toothed surface to cause a spray pattern from the partially opened valve to be a zigzag pattern instead of a flat spray pattern. Also in some cases a butterfly or gate valve is used and the opening and closing of the valve control by a servo motor.

The valve is basically a constant outlet pressure valve. Upon increase of the downstream pressure, the valve opening is reduced to reduce the flow so that downstream pressure is maintained and upon reduced pressure the valve opening increases. Normally the flow will be adjusted by having a spring bias the valve element away from the valve seat and the valve element will have a diaphragm wherein the fluid pressure on one side of the diaphragm will force the valve element toward the valve seat. However as stated before for the butterfly valve, the motor controlling the valve opening can be responsive to a downstream pressure measurement which would control the positioning of the valve through the servo motor. Such valves are known to the valve arts and are commercially available in markets. The programming of the valve to close with additional downstream pressure is within the skill of persons skilled in such art.

Referring to FIG. 1 there may be seen a schematic representation of a water system according to this invention.

Pump 10 connected to motor 12 pumps liquid from a liquid supply which is usually a water supply 14 into downstream pipe 16. With increased pressure in the downstream pipe 16, the pump 10 pumps less water through pipe 16. Centrifugal pumps have this as a inherent characteristic. Also vane pumps with axial flow would have this inherent characteristic. Constant displacement pumps would not have this characteristic; however if the power supply from motor 12 were such that increased load by the pump would reduce the motor speed; this would have the required result. The required result as stated before is that the increased pressure upon pump outlet pipe 16 reduces the volume of flow from the pump.

The motor could be of various types. The water supply could be of any type. It might be an underground well. It might be a low pressure reservoir and the pump was pumping from the reservoir to have the desired outlet pressure of the system.

The outlet of the pipe 16 is connected to valve device 20 that will be described in detail later. The outlet from the valve device is connected to pressure switch 22, reservoir 24, and distribution system 26 by reservoir pipe 28. According to this invention, the reservoir is a pressure reservoir. In an elevated tank the water pressure of the reservoir pipe 28 will vary with the height of water in the reservoir. More commonly, according to the use of this invention, the reservoir would be a pressure tank having a compressed air cap which under normal practice would be separated from the water by a flexible bladder. Increase water in the tank compresses the air and increases the pressure on the pipe 28. Such tanks are well known and commercially upon the market.

The distribution system might be any distribution systems with such examples as a single rural residence; or the complete system for a golf course with a club house including showers, kitchens, etc.; or a small village; or subdivision of a city; or the upper floors of a tall building; or for other liquids such as gasoline pumps.

The pressure switch 22 for an electric motor 12 would be a simple switch which at a preset low pressure provides electrical power to the motor 12 and at a preset high pressure would cut off the electric power to the motor 12. Such switches are well known and commercially available on the market. If the motor 12 were an internal combustion engine, the pressure switch 22 might remain the same but the control for the motor would be required to have automatic starting control at the low pressure output from the pressure switch 22 and also have a shut-off control responsive to the high pressure output from the pressure switch 22. Such motor controls are also well known and commercially available.

Figure 3:
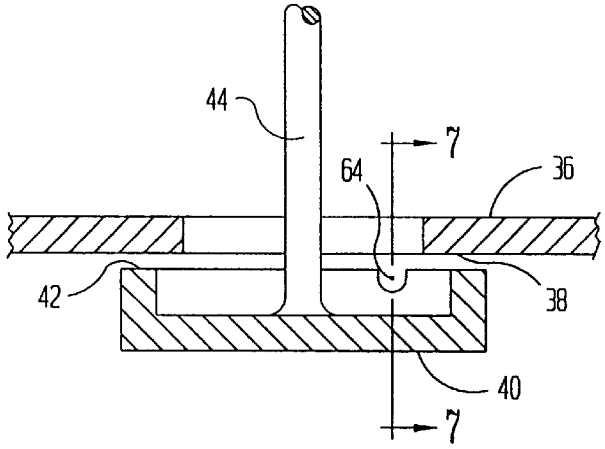
FIG. 3 is an enlarged detail of the valve seat and valve element of the valve device shown in FIG. 2.
Figure 7:
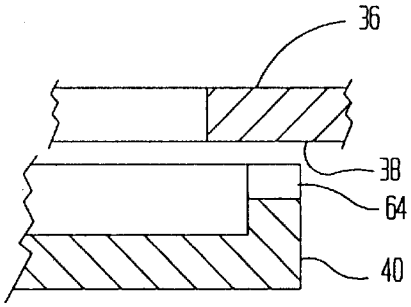
FIG. 7 is a sectional representation of the notch taken substantially along line 7—7 of FIG. 3.
Figure 2:
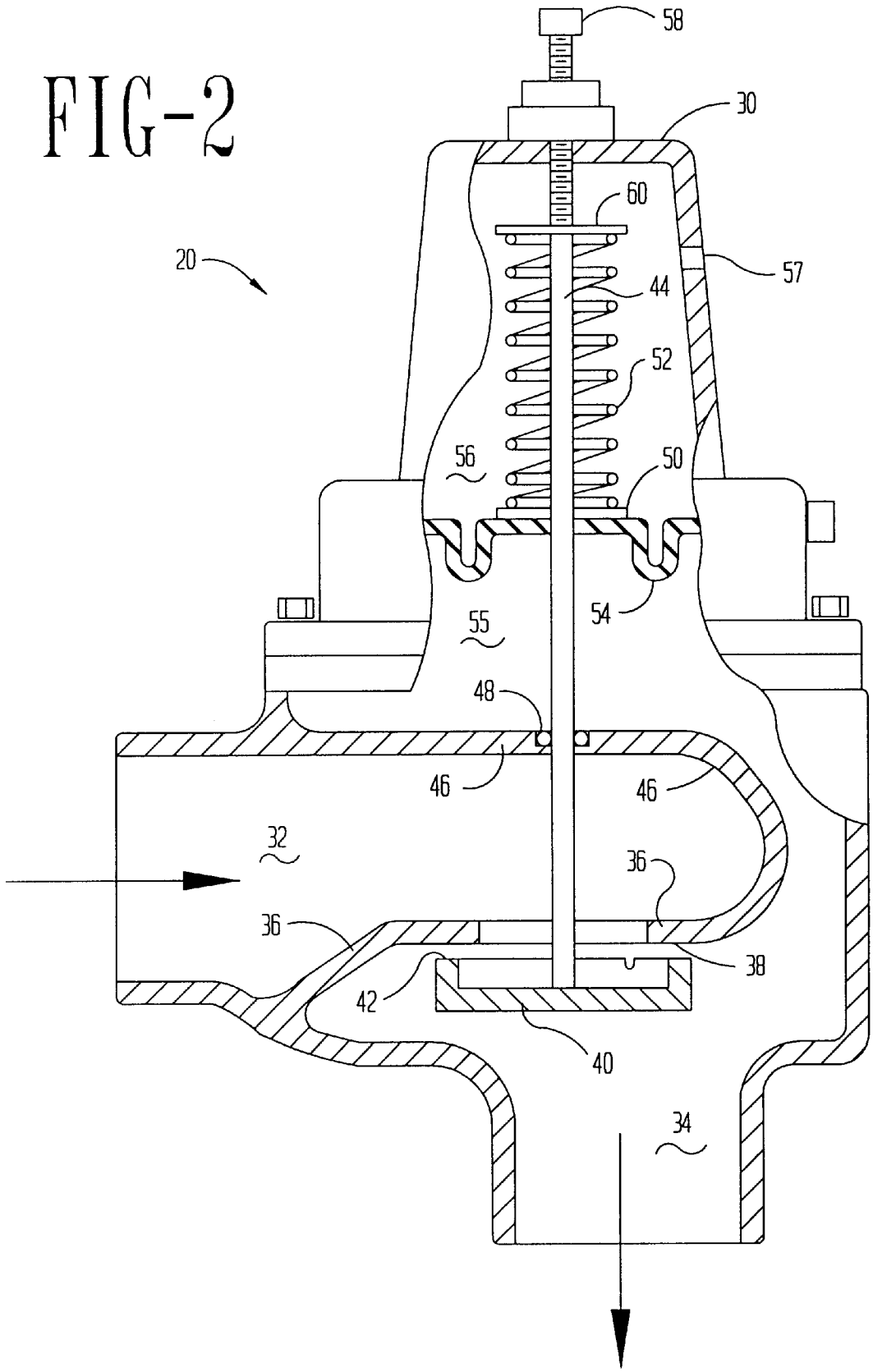
FIG. 2 is a sectional representation somewhat schematic of a valve device according to this invention.

FIG. 2 illustrates a simplified valve device 20 with housing 30. The housing 30 has an upstream space 32 and a downstream space 34 divided by valve seat 36. The upstream space 32 is connected to the pump outlet pipe 16. The downstream space 34 is connected to the reservoir pipe 28. The valve seat 36 has a valve seat seating surface 38. The valve seat seating surface would lie in a plane as more particularly seen in FIG. 3. The valve has a movable valve element 40 which has a plane valve element seating surface 42 also seen in FIG. 3. The valve seating surface 42 lies in a plane which plane is parallel to the valve seat seating surface 38. The valve 40 is movable by valve extension 44. In the valve illustrated in FIG. 2 this valve extension is in the form of a valve stem which extends normal or at right angles to valve seating surface 42. The stem 44 extends upward through seal 48 in partition 46 of the valve body 30. The valve partition 46 might be considered an extension of the valve seat. The seal 48 prevents a significant flow of water from the upstream space 32 to the downstream space 34.

Disc 50 is secured to the valve stem 44 at that portion which extends through the seal 48. Spring 52 biases the valve stem 44 in a direction which increases the distance of the valve element 40 from the valve seat 36. Therefore absence other forces upon the stop 50, the spring will force the valve element 40 to the open position. Diaphragm 54 seals the stop 50 to the valve body 30.

As may be seen in FIG. 2, the partition 46 is located to provide an opening from the downstream space 34 to space 55 which is the partition side of the diaphragm 54.

Valve body space 56 surrounds the spring 52 and that portion of the stem which might extend away from the stop 50. This space 56 is vented to the atmosphere by vent 57. Therefore it may be seen that if the force of the spring 52 exceeds the force of the water pressure of the downstream space 34 that the valve 40 will be opened. However if the pressure in space 34 and space 55 increases it will force the diaphragm upwards to close the valve 40.

The force of the spring may be adjusted by adjusting screw 58 which bears on the top 60 of the spring 52. Therefore adjusting the position of the top 60 will determine the downstream pressure 54 which will completely or fully close the valve. The fully closed condition is that condition when the valve is pressed against the valve seat to fully deflect the seating surfaces 38 and 42 if any flexible or resilient material is used. Therefore the fully closed pressure in the downstream space 34 to fully close the valve may be adjusted by the adjustment screw 58.

The other characteristics of closing the valve 40 will be determined by the design of elements of the valve device 20. Such design elements as changing the strength of the spring 52 or the area of the diaphragm 46 and other design characteristics will determine the opening characteristics of the valve 40. The valve 40 may be designed to go from a fully closed position to a fully open position within a 5 lb. range. That is it could be designed so that at a pressure of 50 p.s.i. it would be fully closed but at a pressure of 45 p.s.i. it would be fully opened. A different design could result in a one pound range for example.

The design of the valve described is only exemplary. It will be understood that instead of the valve moving rectilinear as illustrated that it could be a swinging valve such as a flap valve or a butterfly valve. In such an instance, the valve element 40 would be attached to a rotating shaft which would be in that case the valve extension 44. Then the rotation of the valve extension 44 could be controlled by a Servo motor which was responsive to a pressure device measuring the pressure in the downstream space 34 or the downstream pipe 28. The control of the fluid pressure operating upon the pressure side of the diaphragm 46 could be different. For example a valve might be designed where the partition 46 completely separated the diaphragm chamber 55 from the other spaces of the valve. In such an instance, the diaphragm chamber could be filled with fluids which were connected by tubes to the downstream space 34. In other arrangements, the fluid in the diaphragm chamber 55 could be controlled by a pilot valve which would supply the pressurized liquid to chamber 55.

Those skilled in the art will understand that the structure described to this point is old and well known. All parts and elements thereof are commercially available upon the market.

Also it will be understood that valve device 20 as described at this point is commonly known as a pressure reducing valve or a constant outlet pressure valve.

According to this invention a notch 64 is cut into one of the sealing surfaces. As illustrated it is cut into the sealing surface 42 of the valve element 40. However it could also be cut into the seating surface 38 of the valve seat. The size of the notch would normally be in a range so that it would accommodate a flow at the fully closed pressure of about 5%–10% of the total capability of the pump at that pressure.

Some of the factors indicating the size of the notch 64 would be many fold. For example, if the pump motor were a submergible motor attached to a submergible pump located in the bottom of a well, it would be necessary that the flow of the water through the notch be sufficient to adequately cool the motor over an extended period of time. Also the relative size of the reservoir to the pump capacity would enter into the design factors. For example, if the system were designed so that the distribution system would operate at a pressure from 50 p.s.i. to 30 p.s.i. then the pressure switch would be set to turn on at 30 p.s.i. and off at 50 p.s.i.. If the pump had a capacity of 15 gallons per minute at 50 p.s.i., the reservoir could have a capacity of 5 gallons. The term the "capacity of the reservoir" is meant to indicate in such a case that at the 30 p.s.i. it would have a minimum amount of water and at 50 p.s.i. it would have a maximum amount of water. That is to say that the reservoir system would be such that if it was full at 50 p.s.i. that the reservoir could deliver at least 5 gallons before the pressure switch would start the pump motor at 30 p.s.i.. If no valve device 20 were present, it would be seen that when the motor turned on and if the flow from the reservoir was 5 gallons per minute that the motor would run for less than a minute. In less than a minute, the pump would deliver about 5 gallons to the reservoir, and deliver 5 gallons to the distribution system. The 5 gallons remaining in the reservoir would cause it to reach its 50 p.s.i. and shut down the pump. Then within a minutes time, the reservoir would be empty and it would turn on again. That is to say if there were a continual flow of water from the distributing system of 5 gallons per minute, that the motor would go through a complete cycle of turning on and turning off and turning on again in less than two minutes without a valve device.

However it may be seen that if the notch in the valve were set to flow one gallon a minute (about 7% of full capacity) and the fully closed position of the valve device is 30 p.s.i. that the pump would continue to operate if there were water usage of one gallon a minute or greater. If the water usage were below one gallon per minute, it could be calculated the length of time that the motor would run and be off. If the distribution system had a very low leak, for example, that leaked at the rate of a half a gallon a minute and the notch was cut to flow one gallon a minute that the pump would run for at least ten minutes to refill the tank and be off for at least ten minutes while the tank again drained. This would result in the pump going through a complete cycle in twenty minutes. Analysis will show that if the water usage was more or less than one half the notch size that the cycle would not be shorter.

Figure 4:
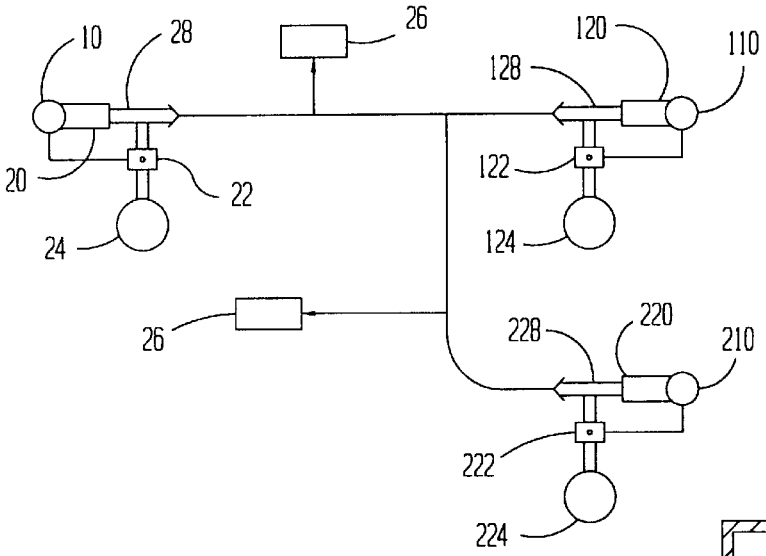
FIG. 4 is a schematic representation showing three pumps using three valve devices according to this invention.

FIG. 4 shows a schematic representation of a liquid system such as water using multiple pumps to supply a system. FIG. 4 would be a typical system using the pumps to pump from wells where the wells were spaced apart but connected into a common system.

Referring to the drawings, many of the details such as the motors for the pump have not been shown. As shown the pump 10 would be connected to a valve device 20 which would supply reservoir pipe 28. The pressure switch 22 would control the motor (not shown) according to the pressure at the pressure reservoir 24. The reservoir pipe would be connected to both of the distribution systems 26.

Likewise pump 110 would be connected to valve device 120 which would supply water to the reservoir pipe 128. The pressure switch 122 would control the motor connected to the pump 110 and the water from reservoir pipe 128 would flow to pressure reservoir 124. Again the reservoir pipe 128 would be connected to distribution systems 26.

Also the pump 210 connected to valve device 220 and reservoir pipe 228 which would be connected to the distribution systems 26. As before the pressure switch 222 would control the motor connected to pump 210.

Normally in such a system, pump 10 would be a 5 horsepower unit while the pumps 110 and 210 would each be a 50 horsepower unit. The pressure switch 22 would be set to turn pump 10 on at 100 p.s.i. and off at 105 p.s.i. The valve device 20 would have a fully closed setting of 100 p.s.i., the same as the on switch 22.

The pressure switch 122 would have a pressure of 95 p.s.i. to turn on the pump 110 and an off setting of 100 p.s.i. The valve device 120 would have a fully closed setting the same as the pressure switch 20 which in this case would be 95 p.s.i..

The third pressure switch 222 would have a on setting of 90 p.s.i. and off setting of 95 p.s.i. . The valve device 220 would have a fully closed setting of 90 p.s.i..

The notches in valve devices 120 and 220 would be the same size as the notch in device 20.

Analysis would show that if the pressure in the system did not go below 95 p.s.i. that only the small 5 horsepower pump 10 would be in operation. When the usage of the water increased so that the system pressure was below 95 p.s.i., the 50 horsepower pump 110 would be activated. This pump would remain running as long as the system pressure was below 100 p.s.i.. However at any point if the pressure was above 95 p.s.i., the output of the pump would be limited to the dribble that flowed through the notch of the valve device 120 which would be an output about equal to the minimum output of the pump 10 or about 5 gal/minute. As stated above, the notch in device 120 supplies a flow about equal to the 5 horsepower system minimum flow. However as the usage of the water increased so that even the pump 110 operating at full capacity could not maintain the water pressure over 90 p.s.i. then the third pump 210 would begin operation. There again until the pressure dropped to 90 p.s.i. its output would be limited. However each of the pumps would run a more than the minimum time setting desired and would stay off more than the minimum time. Of course, this time would depend on the size of the reservoirs and other conditions.

Figure 5:
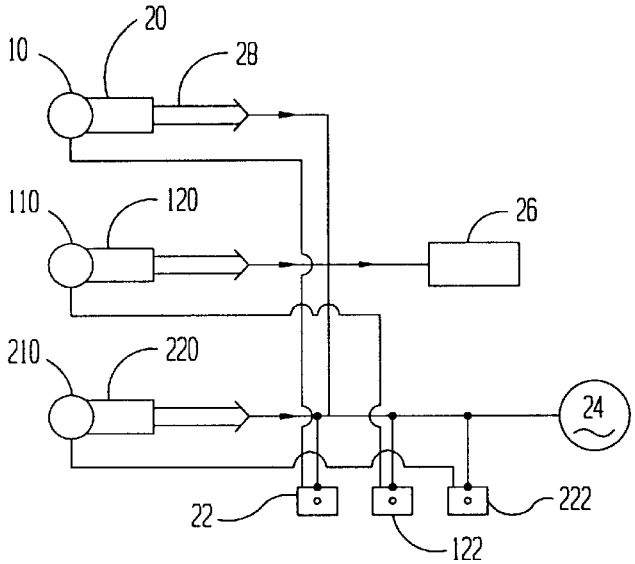
FIG. 5 is another layout of a liquid system having three pumps and three valve devices according to this invention.

Basically the system of FIG. 5 is quite similar to that shown in FIG. 4. However the system in FIG. 5 might be more suitable if all of the pumps pumped from a common low pressure liquid supply and therefore were located reasonably close together. The main feature of the system according to FIG. 5 which is different from FIG. 4 is that there would be only one pressure reservoir rather than the individual reservoirs and that the pressure switches could also be centrally located although each pressure switch would control the starting and stopping of the individual pumps that they were connected to. Also a typical setting that the pressure limits of each of the valve devices 20, 120, and 220 would be the same as set forth in FIG. 4. Also the pressure switches 22, 122, and 222 would be the same as described in FIG. 4.

Analysis will show that with all the systems either for the one unit as shown in FIG. 1 or for multiple units as shown in FIG. 4 and FIG. 5 is that the reservoirs' volume can be greatly reduced from what it is otherwise possible.

Figure 6:
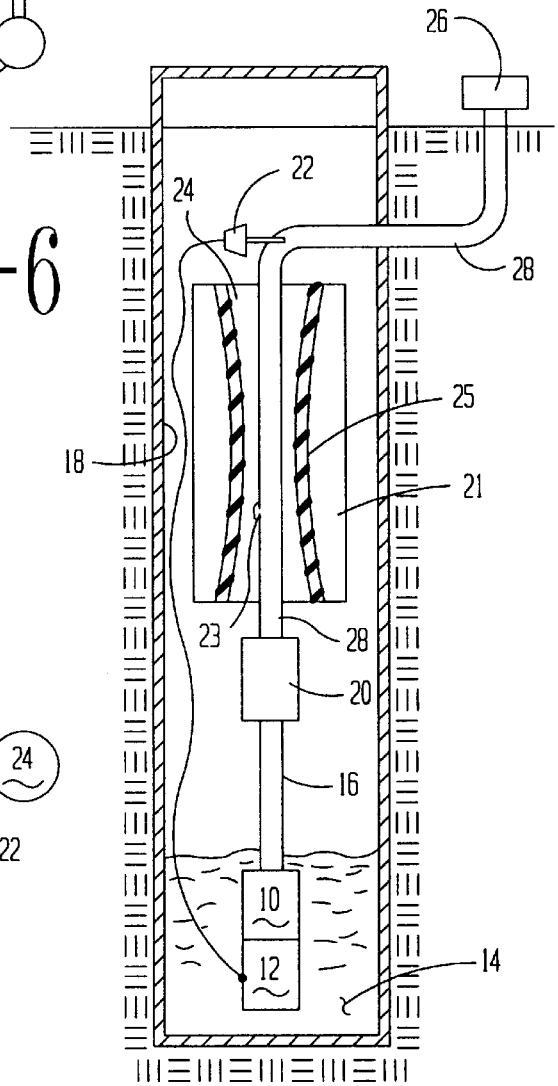
FIG. 6 shows a compact system wherein the pressure reservoir is located within the well casing with the use of a submergible pump.

Referring specifically to FIG. 6, there may be seen a unit in a well casing 18. The water supply 14 would be the water in the well and the pump 10 and motor 12 would be a submergible pump unit as it is well known. This would extend upward through the eduction tube or downstream pipe 16 to the valve device 20. From the valve device it would be through the reservoir pipe 28 which would extend through the pressure reservoir 24. An inlet/outlet 23 opening in the reservoir pipe 28 would provide for the water to flow in and out of the reservoir 24. As is stated, the reservoir would have a air cap 21 which was separated from the water by bladder 25. The pressure switch could be located for convenience near the reservoir 24.

This arrangement has the value of being compact. This system could be extremely useful in an areas where winters are harsh and it was desired to protect the equipment from freezing. The reservoir pipe 28 downstream from the reservoir 24 may be below the surface of the ground, below the frost line. The pressure switch 22 would be available for inspection and still be protected within the confines of the well which with water from the underground source would normally be maintained above the freezing level. For availability in maintenance, the valve device 20 is immediately below the reservoir 24. This design requires that the reservoir 24 be a small capacity reservoir which is possible with the valve device according to this invention.

The embodiments shown and described above is only exemplary. I do not claim to have invented all the parts, elements or steps described. Various modifications can be made in the construction, material, arrangement, and operation, and still be within the scope of my invention. Although the term "pressure tank" normally refers to a sealed tank with an air cap, an elevated container also functions as a pressure tank.

The restrictive description and drawings of the specific examples above do not point out what an infringement of this patent would be, but are to enable one skilled in the art to make and use the invention. The limits of the invention and the bounds of the patent protection are measured by and defined in the following claims.

I claim as my invention:

1. A method of preventing a liquid pump motor from cycling comprising:

a) placing a constant outlet pressure valve device having a valve and a valve seat downstream from a pump connected to said motor, b) placing a pressure tank, a distribution system, and a pressure on/off switch downstream from the valve device, c) always permitting a trickle through the valve device, by d) making a notch between the valve and valve seat, and e) flushing the notch free of all debris upon each opening of the valve device.

2. The method of claim 1 further comprising the method of preventing an additional liquid pump motor from cycling comprising:

f) placing an additional constant outlet pressure valve device having a valve seat and a valve downstream from an additional pump connected to said additional motor, g) placing an additional pressure on/off switch downstream of the additional valve device, h) connecting said additional valve device to said pressure tank, i) always permitting a trickle through the additional valve device, by j) making a notch between the valve and the valve seat of the additional valve device, and k) flushing the notch of the additional valve device free of all debris upon each opening of said additional valve device.

3. A valve device for controlling the flow of liquid from a motor driven pump to a distribution system, said device having a) a housing divided into b) a down stream space and c) an upstream space by d) a valve seat having e) a sealing surface, f) a valve mounted in the housing for movement by g) a valve extension, h) said valve having a sealing surface in mating and operative relationship to said valve seat sealing surface, and i) moving means for moving said valve sealing surface toward said valve seat sealing surface responsive to increased pressure in the downstream space and also j) for fully closing the sealing surfaces at a preset closing pressure in the downstream space;

wherein said improvement comprises:

k) a notch in one of the sealing surfaces, l) said notch has an opening to always allow a trickle flow of liquid through the notch when the sealing surfaces are fully closed.

4. A valve device as defined in claim 3 further comprising:

m) each of said sealing surfaces lies in a plane, and n) each of said sealing surfaces are rigid, o) said sealing surfaces are parallel.

5. A liquid system which includes a valve device as defined in claim 3 comprising:

m) a motor drivingly connected to n) a liquid pump, o) the valve device is connected downstream of the pump, p) a pressure tank connected downstream of the valve device, q) a pressure switch means for starting the motor at a preset starting pressure and for stopping the motor at a preset stopping pressure higher than the preset starting pressure, said pressure switch means connected to the valve device downstream thereof, and r) a distribution system connected to the valve device downstream thereof.

6. A liquid system as defined in claim 5 wherein the preset starting pressure is approximately as high as the preset closing pressure.

7. A liquid system as defined in claim 6 further comprising:

s) an additional motor drivingly connected to t) an additional pump, u) an additional valve device connected downstream of the additional pump, having v) a different preset closing pressure for fully closing the sealing surfaces of the additional valve device, w) an additional pressure switch means with a preset starting pressure at least as high as said preset closing pressure of the additional valve device, connected downstream of the valve device, and x) said distribution system connected to the additional valve device downstream thereof.

8. A liquid system as defined in claim 6 further comprising:

s) a casing extending from the surface of the ground into a water well, t) said pump and motor submerged in water in the well, u) said pressure tank in the casing, and v) said valve device in the casing below the pressure tank.

9. A liquid system as defined in claim 8, further comprising:

w) said pressure switch in the casing below ground level, x) said pressure tank includes a compressed air cap separated from the water by a bladder, and y) a pipe connected to the pressure tank extending from the casing below ground level.

10. A method of preventing a liquid pump motor from cycling comprising:

a) placing a constant outlet pressure valve device having a valve and a valve seat downstream from a pump connected to said motor, aa) said pump having a flow capability at a constant outlet pressure as controlled by said valve, b) placing a pressure tank, a distribution system, and a pressure on/off switch downstream from the valve device, c) always permitting a flow of 5% of said flow capability through the valve device.

11. The method as defined in claim 10 further comprising:

d) always permitting said flow of 5% by making a notch between the valve and valve seat, and e) flushing the notch free of all debris upon each opening of the valve device.

12. The method of claim 10 further comprising:

f) submersing said pump and motor in a water well and always permitting a sufficient flow to cool the motor.

13. A liquid system which includes a valve device for controlling the flow of liquid from a motor driven pump to a distribution system, said valve device having:

a) a housing divided into b) a down stream space and c) an upstream space by d) a valve seat having e) a sealing surface, f) a valve mounted in the housing for movement by g) a valve extension, h) said valve having a sealing surface in mating and operative relationship to said valve seat sealing surface, and i) moving means for moving said valve sealing surface toward said valve seat sealing surface responsive to increased pressure in the downstream space and also j) for fully closing the sealing surfaces at a preset closing pressure in the downstream space;

said liquid system including:

k) a motor drivingly connected to, l) a liquid pump, m) the valve device is connected downstream of the pump, n) a pressure tank connected downstream of the valve device, o) a pressure switch means for starting the motor at a preset starting pressure and for stopping the motor at a preset stopping pressure higher than the preset starting pressure, said pressure switch means connected to the valve device downstream thereof, p) said pump having a flow capacity at said preset closing pressure, and q) a distribution system connected to the valve device downstream thereof;

wherein said improvement comprises:

r) a notch in one of the sealing surfaces, s) said notch has an opening always permitting a flow of 5% of said flow capacity at said preset closing pressure.

14. A valve device in a system as defined in claim 13 further comprising:

t) each of said sealing surfaces lies in a plane, and u) each of said sealing surfaces are rigid, v) said sealing surfaces are parallel.

15. A liquid system as defined in claim 14 wherein the preset starting pressure is approximately as high as the preset closing pressure.

16. A liquid system as defined in claim 15 further comprising:

w) an additional motor drivingly connected to x) an additional pump, y) an additional valve device connected downstream of the additional pump, having z) a different preset closing pressure for fully closing the sealing surfaces of the additional valve device, aa) an additional pressure switch means with a preset starting pressure at least as high as said preset closing pressure of the additional valve device, connected downstream of the valve device, and bb) said distribution system connected to the additional valve device downstream thereof.

17. A liquid system as defined in claim 15 further comprising:

w) a casing extending from the surface of the ground into a water well, x) said pump and motor submerged in water in the well, and y) always permitting sufficient flow to cool said motor.

18. A liquid system as defined in claim 17 further comprising:

z) said pressure tank in the casing, and aa) said valve device in the casing below the pressure tank.

19. A liquid system as defined in claim 18, further comprising:

bb) said pressure tank and pressure switch in the casing below ground level, cc) said pressure tank has a compressed air cap separated from the water by a bladder, and dd) a pipe connecting said valve device to a distribution system extending below the surface of the ground from the casing.

* * * * *